US005642934A

United States Patent [19]

Haddad

[11] Patent Number: 5,642,934

[45] Date of Patent: Jul. 1, 1997

[54] ADJUSTABLE OUTDOOR LIGHT

[75] Inventor: Eric Haddad, East Berlin, Pa.

[73] Assignee: Hadco Division of The Genlyte Group Incorporated, Littlestown, Pa.

[21] Appl. No.: 527,406

[22] Filed: Sep. 13, 1995

[51] Int. Cl.[6] ..... F21V 21/29

[52] U.S. Cl. ..... 362/287; 362/147; 362/268; 362/269; 362/372; 362/374; 362/430

[58] Field of Search ..... 362/147, 269, 362/285, 287, 288, 268, 329, 333, 372, 374, 418, 430, 432

[56] References Cited

U.S. PATENT DOCUMENTS

| | | | |
|---|---|---|---|
| 4,447,863 | 5/1984 | Fenne | 362/287 |
| 4,602,320 | 7/1986 | Tomkin et al. | 362/269 |
| 4,816,969 | 3/1989 | Miller | 362/287 |
| 5,278,737 | 1/1994 | Luce et al. | 362/147 |
| 5,377,087 | 12/1994 | Yoon | 362/287 |
| 5,404,297 | 4/1995 | Birk et al. | 362/287 |

*Primary Examiner*—Ira S. Lazarus
*Assistant Examiner*—Alfred Basichas
*Attorney, Agent, or Firm*—Hopgood, Calimafde, Kalil & Judlowe L.L.P.

[57] ABSTRACT

Described is a low profile, adjustable deck light fixture suitable for outdoor use comprised of a housing having a step lock mechanism for easy, versatile installation and adjustment.

4 Claims, 4 Drawing Sheets

FIG. 6
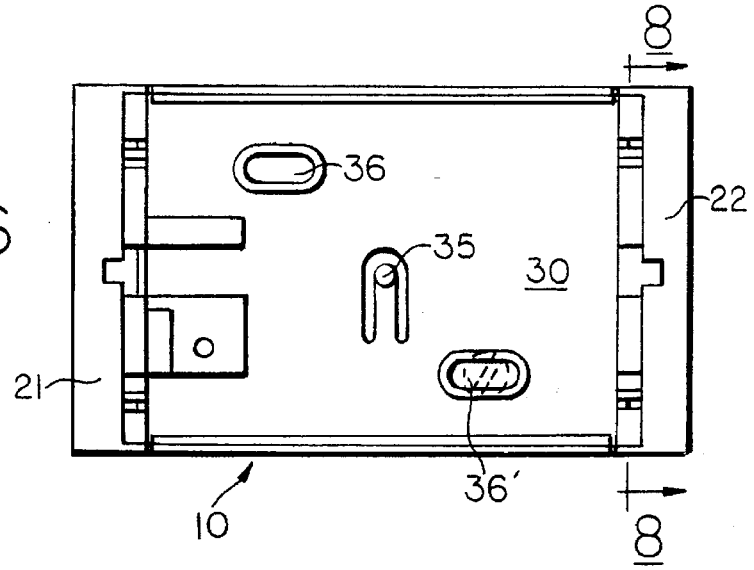
FIG. 7
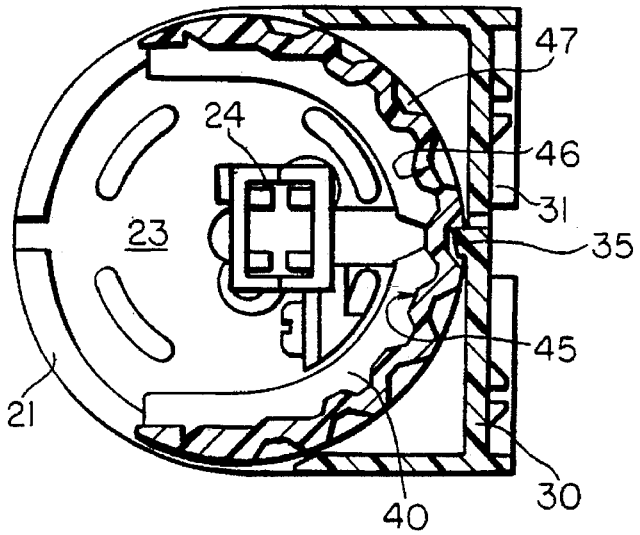
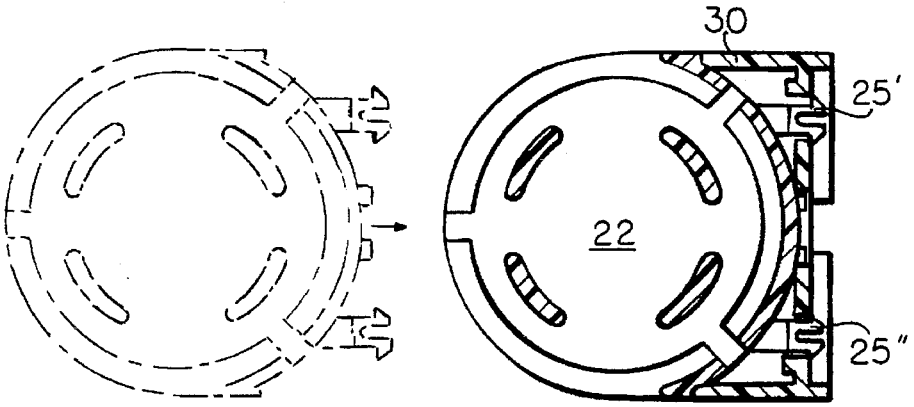
FIG. 8

ADJUSTABLE OUTDOOR LIGHT

BACKGROUND OF THE INVENTION

1. Field of Invention

The present disclosure describes a low profile, adjustable deck light fixture suitable for outdoor use comprised of a novel housing having a step lock mechanism for easy, versatile installation and adjustment.

2. Description of the Related Art

Outdoor deck lights are known such as disclosed in U.S. Pat. No. 3,872,297, which describes a patio light fixture having a lamp enclosed in a frame assembly which can be mounted on a deck using a bracket. Deck lights such as described in the '297 patent are typical of the art which feature prominent, protruding profiles that often clash with the aesthetics of the installation scheme.

For example, U.S. Pat. Nos. 5,001,611, 4,951,184, U.S. Pat. No. Des. 309,504 and U.S. Pat. No. Des. 301,756 describe state-of-the-art light fixtures having lamp and lens assemblies which are designed for mounting onto outdoor patio decks. These patents show that the typical deck light innovations currently available are directed to fixtures made of wood to compensate for their high silhouette profiles by attempting to blend in with the outdoor decks (also typically made of wood) to which they are installed.

Fixtures taught by the prior art do not have features for easily adjusting the angle and direction of illumination, and require adaptations such as brackets or extensions to conform to the patio deck and to obtain the best illumination angle. The problems are aggravated when currently available fixtures are needed for other typical outdoor lighting needs such as installation on the lower surfaces of park bench seats or deck floors for providing indirect illumination.

Conventional deck lights which have high profiles are cumbersome to install and adjust, and detract from the aesthetic appeal required for most outdoor landscaping by protruding from the installation surface. The present invention addresses the need existing in the art for a low profile, outdoor deck light fixture that is easy to install and in which the angles and direction of illumination are easily adjusted.

OBJECTS OF THE INVENTION

Accordingly, it is an object of this invention to provide an improved outdoor light fixture having a low height and silhouette profile with an adjustable step lock mechanism for versatile installation and easy adjustment of the angle and direction of illumination. These and other objects will be apparent in the following description.

SUMMARY OF THE INVENTION

The present invention is a low profile, adjustable outdoor light fixture comprising a mounting bracket and a lamp housing having a front edge, a first side edge, a second side edge and a means for adjustably locking the housing to the mounting bracket. A lens cover is attached to the front edge, a first end cap is attached to the first side edge and a second end cap is attached to the second side edge of the housing.

The first and second end caps snap into the mounting bracket which allows the light fixture to be mounted to a desired surface. The mounting bracket comprises a locking knob which incrementally engages the means for adjustably locking the housing to the mounting bracket to provide adjustable angles or directions of illumination for the outdoor light fixture.

The lamp housing further comprises an exterior convex surface and an interior concave surface, and the means for adjustably locking the housing comprises a series of spaced depressions formed in the exterior convex surface, wherein the spaced depressions protrude into the concave surface and sequentially engage the locking knob of the mounting bracket to provide the adjustable angles or directions of illumination.

The lens cover used in the outdoor light fixture is detachable, and is a light-diffusing lens comprised of a plurality of parallel, elongated ridges. The end caps are connected to the first and second edges of the lamp housing via snap locks, and at least one end cap has an interior surface comprising a boss means for mounting a lamp socket.

BRIEF DESCRIPTION OF THE DRAWINGS

FIG. 6 is a front elevational view into the interior of the fixture with the lens and housing removed.

FIG. 7 is a side cut-away view taken from lines 7—7 in FIG. 5 and shows a sectional view of the step lock mechanism and portions of the lamp socket and boss.

FIG. 8 is a side cut-away view taken from lines 8—8 in FIG. 6 and shows an end cap attached to the sectioned mounting bracket and in the detached position (drawn in phantom lines).

DETAILED DESCRIPTION OF THE INVENTION

Figure 1:
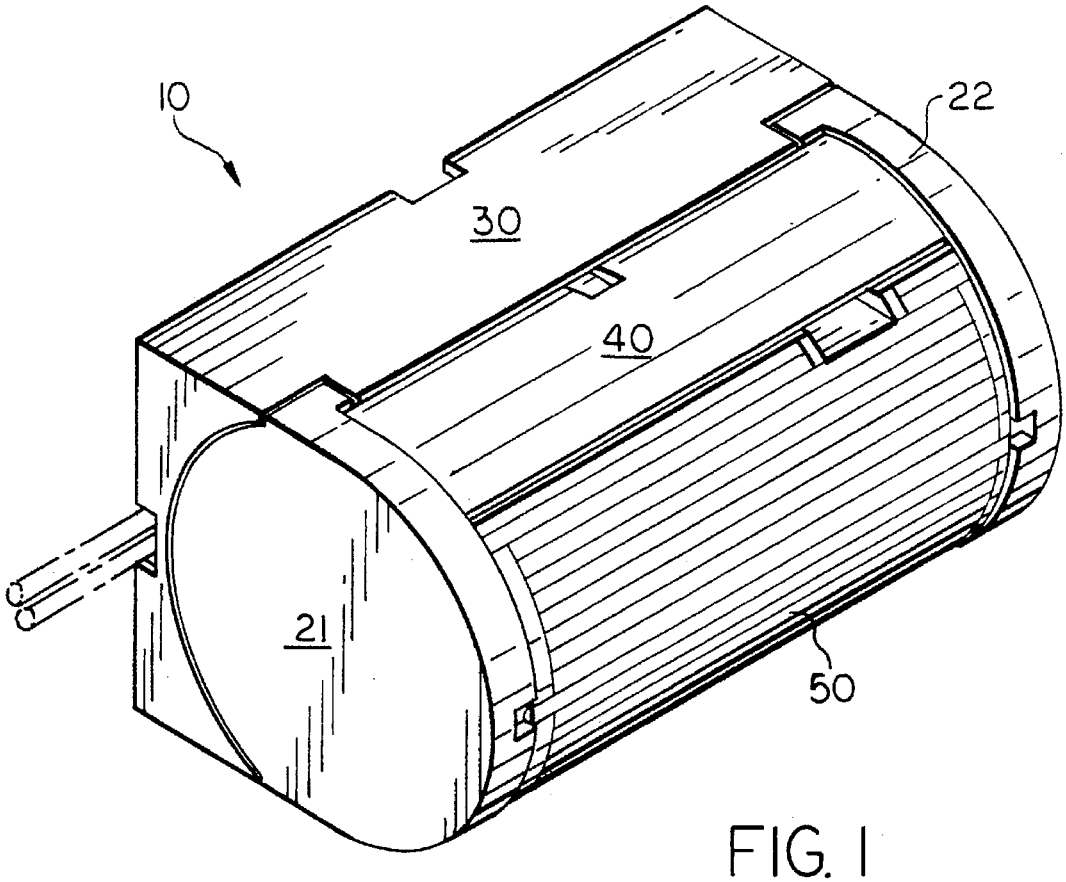
FIG. 1 is a perspective view of the present invention showing the low and compact profile offered by the fixture.

FIG. 1 depicts the adjustable outdoor light designated with numeral 10. Outdoor light 10 is comprised of end caps 21 and 22, mounting bracket 30, housing 40 and cover lens 50. The phantom lines shown in FIG. 1 depict an external lead line.

Figure 2:
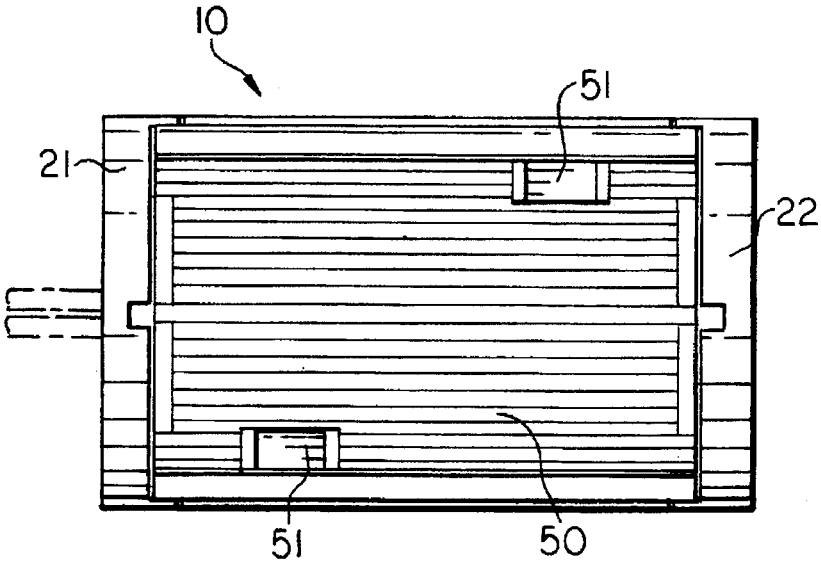
FIG. 2 is a front elevational view of the invention prominently showing the lens cover and the low frontal profile.

FIG. 2 shows the low frontal profile offered by the outdoor light fixture and the maximum coverage of the anterior area with cover lens 50. Cover lens 50 is a detachable, light-diffusing spread lens comprised of a plurality of parallel, elongated ridges as shown. The elongated ridges provide an even spread of illumination through a lateral and horizontal "prism effect."

Figure 3:
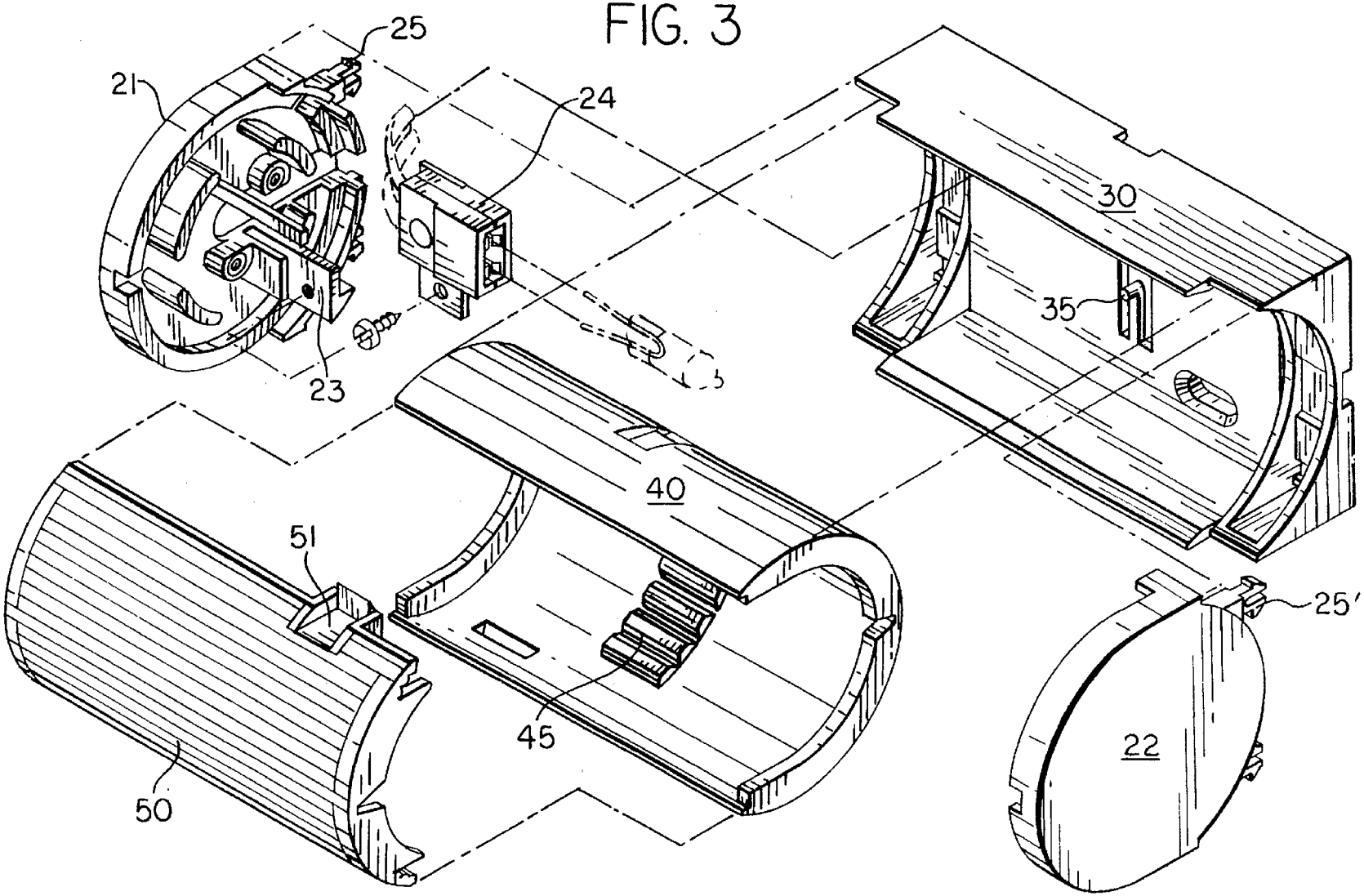
FIG. 3 is an exploded perspective view of the component pieces which comprise the present invention.

FIG. 3 depicts the primary component pieces of the outdoor light in an exploded perspective view. Both end caps 21 and 22 have snap locks such as 25 and 25' which snap conveniently into mounting bracket 30 for easy assembly. The front portion of housing 40 is designed to receive lens 50, while the side aspects of housing 40 engage end caps 21 and 22. The mounting bracket 30 includes a locking knob 35 which adjustably engages the step lock mechanism 45 to adjustably lock housing 40.

As shown in FIG. 3, the interior aspect of end cap 21 contains a socket mounting boss 23 to which is mounted lamp socket 24. Although FIG. 3 shows boss 23 as being located on end cap 21, one skilled in the art can appreciate that boss 23 could be located elsewhere within the housing 40, such as on the other end cap 22, without detracting from the present concept.

In the preferred embodiment, substantially all components are made of weather resistant non-metallic material. For example mounting bracket 30 and lens 50 can be made of a polycarbonate called Lexan™, while housing 40 can be made of a plastic, polyphenylene sulfite (PPS) available under the trade name Ryton™. Such materials are particularly suited for harsh environmental areas such as coastal regions where salt spray devastates conventional deck lights such as those made of oxidizable metals or degradable wood.

Figure 4:
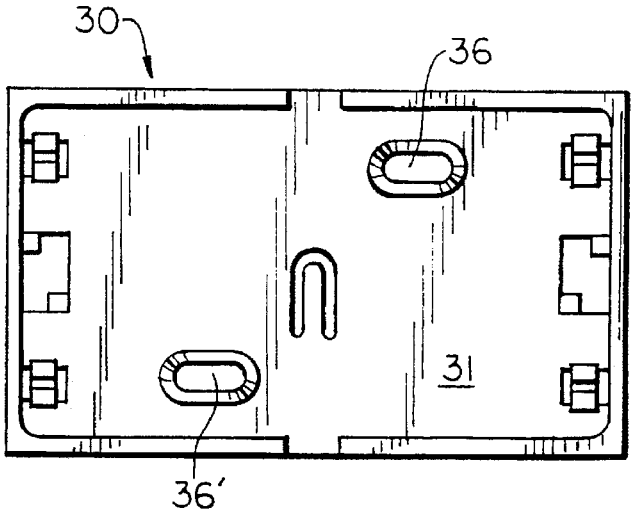
FIG. 4 is rear elevational view showing the mounting template and an external view of the wire slots.

FIG. 4 is the rear elevational view of mounting bracket 30 and shows mounting template 31 having wire slots 36 and 36'.

Figure 5:
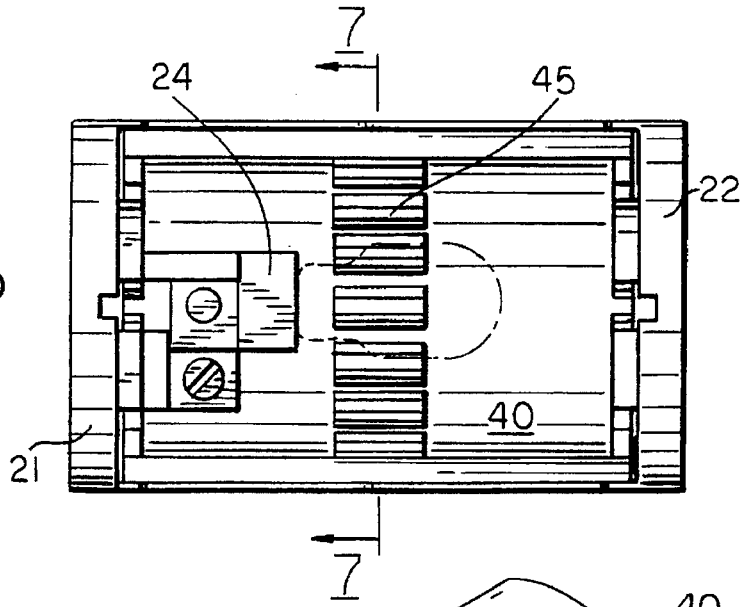
FIG. 5 is a front elevational view into the interior of the fixture with the lens removed, and shows a lamp drawn in phantom lines with portions of the step lock mechanism of the housing shown in the background.
Figure 5A:
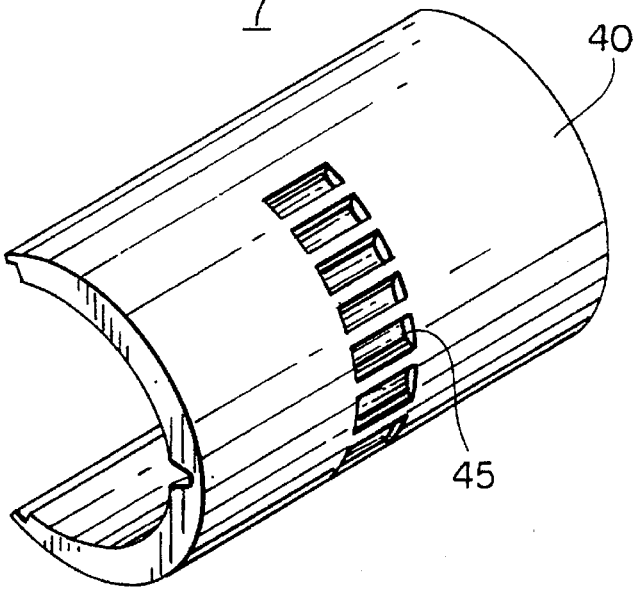
FIG. 5A is a rear perspective of the housing depicting spaced depressions formed along a vertical center line in its mid-section.

FIG. 5 is a front elevational view into the interior of the fixture with the lens (50) removed, and shows a lamp drawn in phantom lines in the foreground with step lock mechanism 45 of housing 40 shown in the background. FIG. 5A is a rear perspective view showing step lock mechanism 45 as comprising spaced depressions formed in the convex outer surface of housing 40. In the preferred embodiment, the spaced depressions of step lock mechanism 45 are formed along a vertical center line in the mid-section of housing 40, as shown in FIGS. 5 and 5A. Although step lock mechanism 45 is depicted in FIG. 5A as comprising a series of spaced depressions formed into housing 40 during casting or extrusion, which cooperate with locking knob 35 (FIG. 3) for adjustably locking the housing, one of ordinary skill in the art will appreciate that the step lock mechanism can comprise a series of depressions, protrusions or other physical forms of various shapes and sizes. Furthermore, the depressions, protrusions or other components of the step lock mechanism do not necessarily have to be vertically aligned along a single center line. The components could be spaced along different horizontal or vertical lines or set up in a type of "checkerboard" pattern, to name but a few examples.

FIG. 6 is another front elevational view into the interior of outdoor light 10 with the lens (50) and housing (40) removed. The interior aspects of mounting bracket 30 such as wire slots 36 and 36' are shown in the background along with locking knob 35. Locking knob 35 and mounting bracket 30 are cast from the same mold, and FIG. 3 shows knob 35 extending from the lower aspects of a rectangular, cut-out portion in bracket 30. When housing 40 is placed into mounting bracket 30, the housing is rotated such that locking knob 35 sequentially engages a step of the step lock mechanism 45 until the desired angle and direction of illumination is achieved.

FIG. 7 is a side cut-away view taken from lines 7—7 in FIG. 5, and depicts a sectional view of step lock mechanism 45 which shows a series of spaced protrusions 46 and depressions 47 in an arcuate line formed in housing 40. Spaced depressions 47 formed in the exterior convex surface of housing 40 sequentially engage locking knob 35 of mounting bracket 30 to provide incremental stepwise locking of knob 35.

In this manner, step lock mechanism 45 in conjunction with locking knob 35, allows for incremental angular adjustment of housing 40 for variations in the angle and direction of illumination in the upward or downward direction. This feature allows the outdoor light to be installed in substantially any position on a deck, provide the desired angle and direction of illumination and maintain its low profile nature. FIG. 7 also depicts lamp socket 24 on boss 23 of end cap 21.

FIG. 8 is a side cut-away view taken from lines 8—8 in FIG. 6 and shows end cap 22 attached to the sectioned mounting bracket 30 and in the detached position (drawn in phantom lines). Also depicted are snap locks 25' and 25" of end cap 22 positioned within mounting bracket 30.

Once assembled, the outdoor light is ready for installation. An exemplary installation procedure begins with removal of lens 50 with a small flat screw-driver by pressing either notch 51 or 51' (shown in FIG. 2). Referring to FIG. 3 for reference, housing 40 is rotated on bracket 30 so that the open side of housing 40 is pointed up towards bracket 30. Housing 40 is then removed from bracket 30 and if a lamp is supplied, it too is removed from socket 24.

Referring to FIG. 4, using mounting template 31 flush against the desired mounting surface, holes are drilled through wire slots 36 and 36' into the mounting surface. Screws are positioned into the wire slots while also routing wire through at least one slot being careful to avoid pinching the wire. The screws are then drilled into the mounting surface.

Housing 40 is replaced into bracket 30, followed by placement of a desired lamp (such as a low voltage wedge lamp) into socket 24. Lens 50 is next replaced, and wiring according to appropriate voltage is performed. Finally, the appropriate angle is adjusted using a flat screwdriver in the notches (such as 51) of lens 50 to direct illumination in the desired sector.

Various modifications and alterations to the present invention may be appreciated based on a review of this disclosure. These changes and additions are intended to be within the scope and spirit of this invention as defined by the following claims.

What is claimed is:

1. A low profile, adjustable outdoor light fixture, comprising:

a mounting bracket for mounting said light fixture to a desired surface;

a lamp housing comprising a front edge, a first side edge, a second side edge, and a means for adjustably locking said housing to said mounting bracket;

said lamp housing further comprising an exterior convex surface and an interior concave surface, and said means for adjustably locking said housing to said mounting bracket comprises a series of spaced depressions formed in said exterior convex surface, wherein said spaced depressions protrude into said concave surface and sequentially engage said locking knob of said mounting bracket to provide said adjustable angles or directions of illumination;

a lens cover attached to said front edge;

a first end cap attached to said first side edge and a second end cap attached to said second side edge; and said mounting bracket being adapted for connection to said first and second end caps, said mounting bracket comprising a locking knob, wherein said means for adjustably locking said housing to said mounting bracket incrementally engages said locking knob to provide adjustable angles or directions of illumination for said outdoor light fixture.

2. The outdoor light of claim 1, wherein said lens is a detachable, light-diffusing lens.

3. The outdoor light of claim 1, wherein said end caps are connected to said first and second edges via snap locks.

4. The outdoor light of claim 1, wherein at least one of said end caps has an interior surface comprising a boss means for mounting a lamp socket.

* * * * *